US011278104B1

(12) United States Patent
Soriano

(10) Patent No.: US 11,278,104 B1
(45) Date of Patent: Mar. 22, 2022

(54) BOTTLE ADAPTERS

(71) Applicant: Carl Matthew Soriano, Norwalk, CT (US)

(72) Inventor: Carl Matthew Soriano, Norwalk, CT (US)

( * ) Notice: Subject to any disclaimer, the term of this patent is extended or adjusted under 35 U.S.C. 154(b) by 0 days.

(21) Appl. No.: 17/363,330

(22) Filed: Jun. 30, 2021

Related U.S. Application Data

(60) Provisional application No. 63/046,698, filed on Jul. 1, 2020.

(51) Int. Cl.
*A45F 3/16* (2006.01)
*A47G 19/22* (2006.01)

(52) U.S. Cl.
CPC ..... *A45F 3/16* (2013.01); *A47G 19/2222* (2013.01); *A45F 2003/166* (2013.01)

(58) Field of Classification Search
CPC .... A45F 3/16; A47G 19/2222; A47G 19/2205
USPC ..... 220/709, 705, 203.19, 203.01, 366.1; 215/229, 388, 387, 311, 307
See application file for complete search history.

(56) References Cited

U.S. PATENT DOCUMENTS

| | | | | |
|---|---|---|---|---|
| 2,163,555 | A * | 6/1939 | Geyer | B01L 3/10 215/4 |
| 4,852,781 | A * | 8/1989 | Shurnick | A45F 3/16 224/148.2 |
| 5,381,924 | A | 1/1995 | Kiefel | |
| 5,782,383 | A | 7/1998 | Robinson | |
| 5,996,836 | A * | 12/1999 | Betras | A45F 3/16 220/709 |
| 9,392,929 | B2 | 7/2016 | Bendele et al. | |
| 2002/0092858 | A1 | 7/2002 | Bowman | |
| 2003/0168462 | A1 * | 9/2003 | Kiyota | B65D 47/06 220/709 |
| 2016/0100703 | A1 * | 4/2016 | Fenner | A47G 19/2222 215/229 |

* cited by examiner

*Primary Examiner* — Robert J Hicks
(74) *Attorney, Agent, or Firm* — Miller IP Law LLC

(57) ABSTRACT

The system may include a bottle to contain a liquid, a drinking tube, and a bottle adapter. The bottle adapter may couple to the bottle to position the drinking tube within the bottle. The bottle adapter may include a body, an aperture, an engagement interface, a central channel, and a vent structure. The body may have a cylindrical geometry. The aperture is disposed at an end of the body and sized to receive the drinking tube to allow the drinking tube to pass through the bottle adapter. The engagement interface is disposed at another end of the body opposite the aperture to couple the bottle adapter to the bottle. The central channel extends through the bottle adapter along a central axis of the body. The vent structure is formed in the body to intake air into the central channel along an exterior of the drinking tube within the bottle adapter.

20 Claims, 8 Drawing Sheets

BOTTLE ADAPTERS

CROSS-REFERENCE TO RELATED APPLICATIONS

The present application claims priority to U.S. Non-Provisional Patent Application No. 63/046,698 entitled "QUICK ACCESS BITE VALVE AND DRINKING TUBE ADAPTER FOR FLIP TOP SPOUT BOTTLE LIDS", filed on 1 Jul. 2020. The entire contents of the above-listed application are hereby incorporated by reference for all purposes.

BACKGROUND

Water is a critical resource for support of life. Hydration is a primary concern in a wide variety of activities both indoor and outdoor. The intake of a proper amount of water at a corresponding frequency can support good health and reduce the chance of temporary or permanent damage. Water can be kept in a variety of ways which may vary with the type of activity or environment in which water will be carried.

A water bottle adapter may provide the ability to interface with a water bottle lid to allow a drinking tube to extend into the water bottle and form a pathway to carry the liquid from the water bottle to the user. This allows the user to benefit from both the flexibility and utility of the water bottle without the need to remove the water bottle from the park or bag.

The water bottle adapters engage with the water bottle lids to form a secure connection through which the drinking tube may pass. The drinking tube may be a single continuous tube extending from the water bottle, through the adapter, and to the user. The water bottle adapters also provide sufficient ventilation to avoid drawing vacuum on the water bottle as liquid is removed from the water bottle during drinking.

BRIEF DESCRIPTION OF THE DRAWINGS

The present description will be understood more fully when viewed in conjunction with the accompanying drawings of various examples of bottle adapters. The description is not meant to limit the bottle adapters to the specific examples. Rather, the specific examples depicted and described are provided for explanation and understanding of bottle adapters. Throughout the description the drawings may be referred to as drawings, figures, and/or FIGs.

DETAILED DESCRIPTION

Bottle adapters as disclosed herein will become better understood through a review of the following detailed description in conjunction with the figures. The detailed description and figures provide merely examples of the various embodiments of bottle adapters. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

Conventional water containers may include water bottles with different drinking interfaces. For example, some water bottles may require complete removal of a lid in order to drink the water. Others may have an opening formed in the lid that is fixed open. Some may include openings that can be manually opened to allow for drinking. Other water containers may include bladders for carriage in a backpack or other accessory. However, bladders lack the utility and flexibility of water bottles and water bottles must carried in-hand or removed from a bag or pack to access the water or other liquid carried therein. This requires users to pick one mode of water carriage and be restricted to such or to carry redundant systems for flexibility of access.

Implementations of the water bottle adapters described and claimed herein may address some or all of the problems described above.

Figure 1:
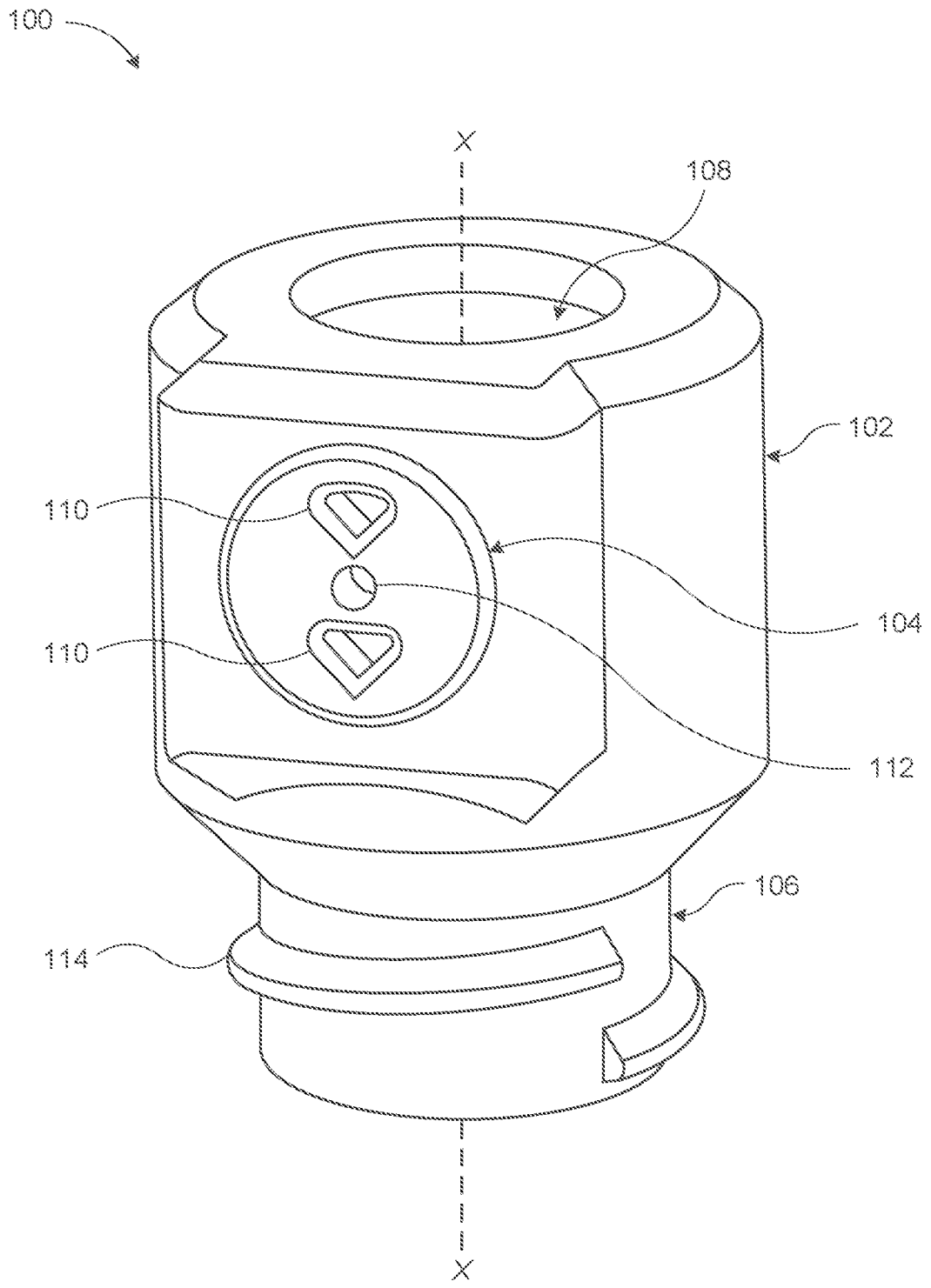
FIG. 1 illustrates a perspective view of a bottle adapter, according to an embodiment.

FIG. 1 illustrates a perspective view of a bottle adapter 100, according to an embodiment. Embodiments of the bottle adapter may allow for the use of a drinking tube with a water bottle for easy and quick access to the liquid carried in the water bottle.

In some embodiments, the bottle adapter 100 includes a body 102. The bottle adapter 100 may also include a vent structure 104 disposed on a side of the body 102. While the vent structure 104 is shown at a particular location and orientation on the bottle adapter, other locations and orientations may be used. The bottle adapter 100 may also include an engagement interface 106 extending from an end of the body 102.

The body 102 may be approximately cylindrical in shape. The body 102 may be hollow. The hollow shape may form a central channel 108 extending through the engagement interface 106 and through the body 102 along a central axis X of the body 102. The vent structure 104 may include a vent orifice 110 extending through a thickness of the body 102 from an exterior of the vent structure 104 to the central channel 108. The vent structure 104 may also include a valve mount 112 sized to accept and hold in position a valve seal.

In some embodiments, the vent structure 104 may be configured to allow air to pass into the central channel 108 from outside the bottle adapter 100. In some embodiments, the air may pass through one or more vent orifices 110 to enter the central channel 108. In passing through the vent orifices 110, the air may be allowed to move from outside the bottle adapter 100 to the central channel 108 but air and liquid may be hindered from moving from the central channel 108 to an exterior of the bottle adapter 100 via the vent orifices 110 by a seal or similar structure.

In some embodiments, the engagement structure 106 includes a thread interface 114. In some embodiments, the thread interface 114 facilitates coupling of the bottle adapter 100 to a water bottle lid or similar structure. The thread interface 114 may be consistent in size, shape, cross-section, etc. or variable in one or more geometry, aspect, or characteristic.

Figure 2:
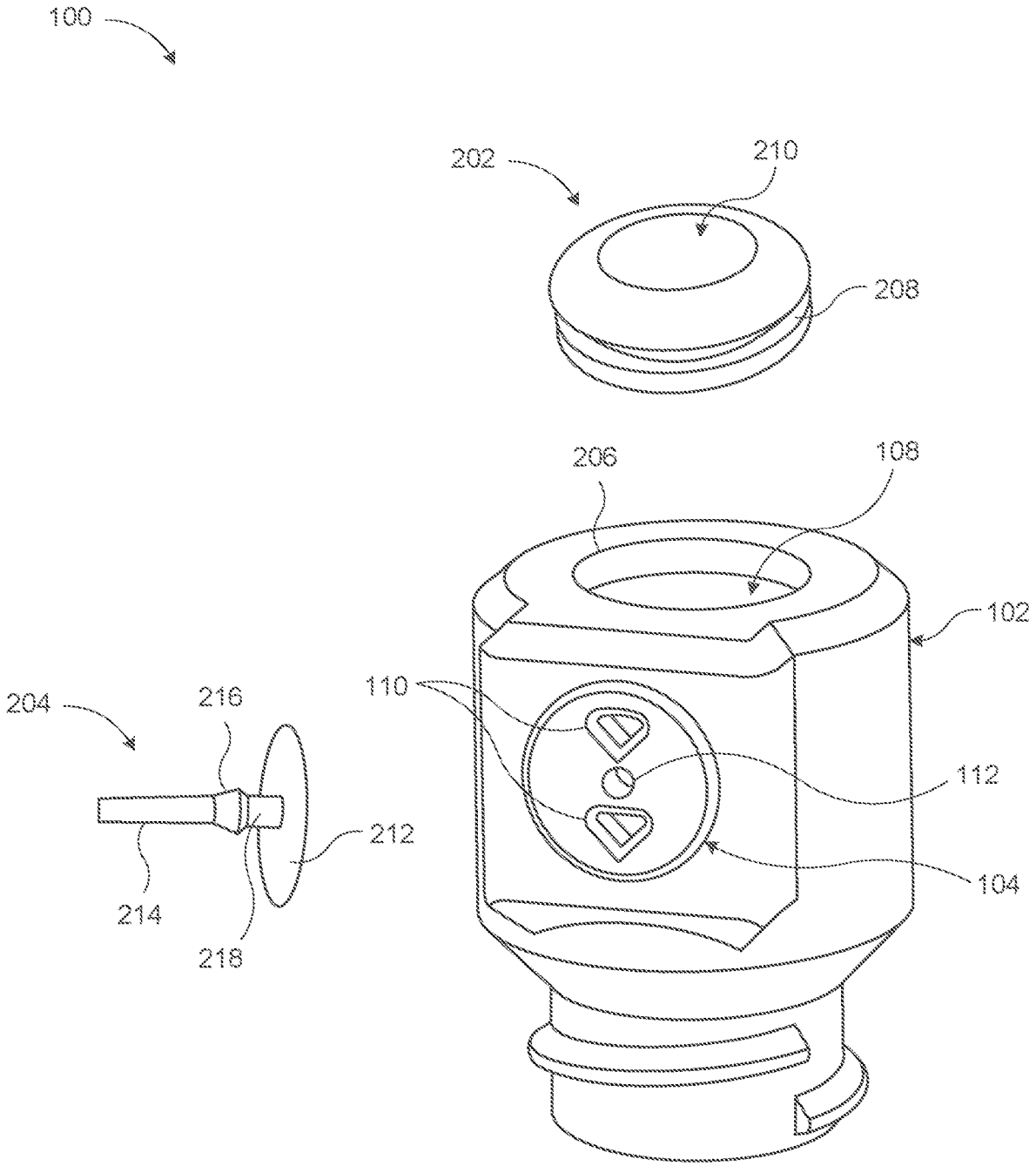
FIG. 2 illustrates an exploded view of the bottle adapter of FIG. 1 with a gasket and a valve seal, according to an embodiment.

FIG. 2 illustrates an exploded view of the bottle adapter 100 of FIG. 1 with a grommet 202 and a valve seal 204, according to an embodiment. Embodiments may provide a quick access to a liquid stored in a container.

In some embodiments, the bottle adapter 100 may include a grommet 202 sized to fit an aperture 206 of the bottle adapter 100. The aperture 206 may be disposed in the body 102 to be opposite the engagement interface 106. In some embodiments, the grommet 202 includes a retention channel 208 extending around a periphery of the grommet 202. The retention channel 208 may be recessed into the grommet 202 to fit a radius, diameter, and/or thickness of the aperture 206 of the body 102 of the bottle adapter 100. The grommet 202 may include a through-hole 210 extending through the grommet 202. The through-hole 210 may be sized and/or positioned to correspond with the central channel 108 or central axis X of the body 102 when positioned in the aperture 206 of the body 102. In some embodiments, the grommet 202 is at least partially formed of a flexible rubber, plastic, or similar material. The material of the grommet 202 may allow for deformation of the grommet 202 for installation and removal of the grommet 202 from the aperture 206. In some embodiments, the material of the grommet 202 may also facilitate insertion and removal of a drinking tube or other structure from within the through-hole 210 of the grommet 202. This may allow for adjustment of a length of a drinking tube passing through the grommet 202 to accommodate different bottle sizes and tube depths within the bottle.

In some embodiments, the bottle adapter 100 also includes a valve seal 204. The valve seal 204 may be sized to be secured relative to the vent structure 104 to, at least partially, control movement of fluids through the vent structure 104. In some embodiments, the valve seal 204 includes a seal flange 212 forming a disc and a valve stem 214 extend perpendicularly from a center of the seal flange 212. The valve stem 214 may include a retention structure 216 which has a diameter larger than a diameter of the valve stem 214. The retention structure 216 may be positioned on the valve stem 214 at a distance from the seal flange 212. The distance between the retention structure 216 and the seal flange 212 may form a retention region 218.

In some embodiments, the valve seal 204 may be configured to be positioned with the seal flange 202 internal to the body 102 at the vent structure 104 with the valve stem 214 extending through the valve mount 112 such that the retention structure 216 is positioned outside the body 102 with the retention region 218 located within the valve mount 112. In some embodiments, the tension on the valve stem 214 at the retention region 218 applied by the larger diameter of the retention structure 216 may allow the seal flange 212 to maintain a seal on the interior of the body 102 at the vent structure 104 to function as a one-way valve.

Figure 3:
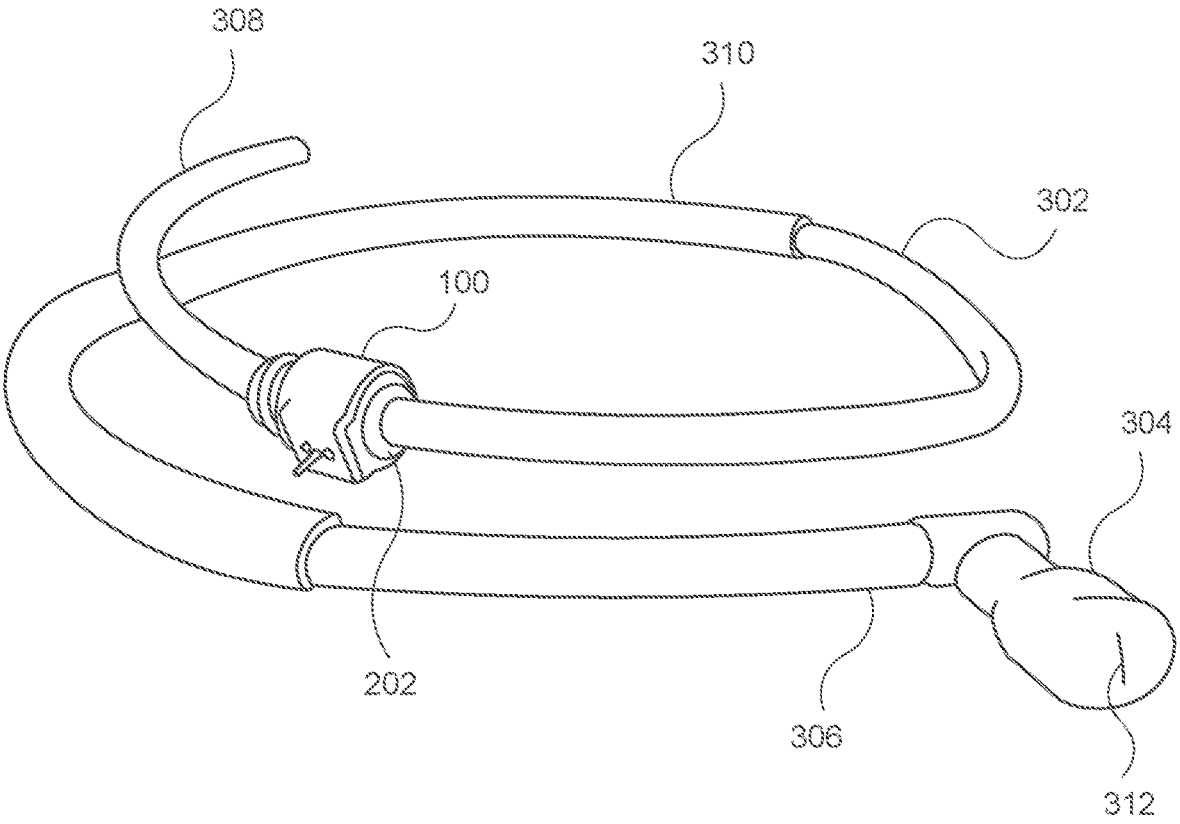
FIG. 3 illustrates a perspective view of a bottle adapter positioned on a drinking tube with a bite valve, according to an embodiment.

FIG. 3 illustrates a perspective view of a bottle adapter positioned on a drinking tube 302 with a bite valve 304, according to an embodiment. Embodiments may facilitate the use of the bite valve 304 in combination with a bottle.

In some embodiments, the bottle adapter 100 may be positioned on the drinking tube 302 to be coaxial with the drinking tube 302. In some embodiments, the bite valve 304 may be coupled to the drinking tube 302 at a first end 306 of the drinking tube 302. The drinking tube 302 may extend, unbroken, through the bottle adapter 100. The bottle adapter 100 may be held in-place on the drinking tube 302 by the grommet 202. The grommet 202 may apply a frictional force to the drinking tube 302 to maintain the position of the bottle adapter 100 on the drinking tube 302. In some embodiments, the grommet 202 allows the bottle adapter 100 to be adjustably positioned on the drinking tube 302 to accommodate different sizes of bottle or to allow the user to adapt a depth of the drinking tube 302 in the bottle.

A second end 308 of the drinking tube 302 may be positioned relative to the bottle adapter 100 to be inserted into a bottle such that the bottle adapter 100 is positioned, on the drinking tube 302, to be between the bite valve 304, located at the first end 306 of the drinking tube 302, and the second end 208 of the drinking tube 302.

In some embodiments, the drinking tube 302 may also include an insulating sleeve 310. The insulating sleeve 310 may provide resistance to warming and/or cooling of the drinking tube 302 and/or contents of the drinking tube 302. In some embodiments, a neoprene or other material having insulative characteristics may be used. The insulating sleeve 310 may extend over some or all of the drinking tube between the bottle adapter 100 and the bite valve 304.

The bite valve 304 may be positioned at the first end 306 of the drinking tube 302 to facilitate dispensing of a liquid through the drinking tube 302. The bite valve 304 may be operated by applying a squeezing force to open a port 312 in the bite valve 304. While a bite valve 304 is shown and discussed, other valved, gates, switches, or dispensing mechanisms may be used.

Figure 4:
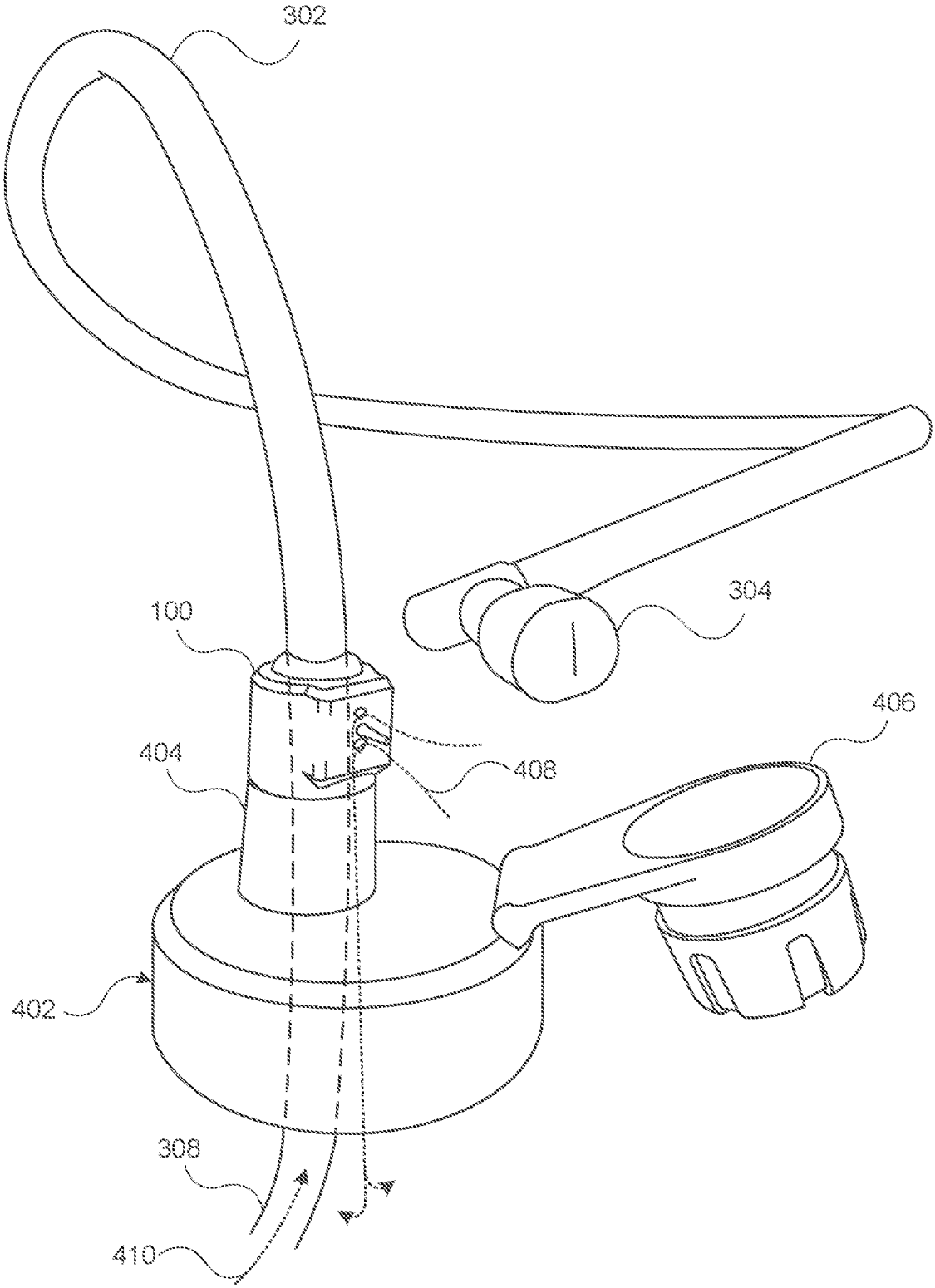
FIG. 4 illustrates a perspective view of a bottle adapter coupled to a bottle lid to position the drinking tube to pass through the bottle lid, according to one embodiment.

FIG. 4 illustrates a perspective view of a bottle adapter 100 coupled to a bottle lid 402 to position the drinking tube 302 to pass through the bottle lid 402, according to one embodiment. Embodiments may facilitate extension of access to a water bottle.

In some embodiments, the bottle adapter 100 may couple to the bottle lid 402 at a spout 404 of the bottle lid 402. In some embodiments, the spout 404 may be a raised or extended structure of the bottle lid 402. In other embodiments, the spout 404 may be an unraised opening in the bottle lid 402. In some embodiments, the bottle adapter 100 may couple to the spout 404 to secure the bottle adapter 100 relative to the bottle lid 402. The bottle adapter 100 may form a water resilient seal between the bottle lid 402 and the drinking tube 302 to resist leaking of a liquid at the bottle adapter 100.

In some embodiments, the bottle adapter 100 mimics or at least partially replaces a spout closure 406 of the bottle lid 402. In some embodiments, the thread interface 114 of the bottle adapter 100 may be similar to a thread pattern of the spout closure 406 or otherwise compatible with a structure of the spout 404 such that the bottle adapter 100 may be secured relative to the bottle lid 402.

The bottle adapter 100 may facilitate a pathway to allow a liquid to pass into the second end 308 of the drinking tube 302, through the bottle lid 402 and the bottle adapter 100 via the drinking tube 302, and out through the bite valve 304.

In some embodiments, the bottle adapter 100 allows air 408 to pass back through the bottle lid 402 by allowing air to flow through the bottle adapter 100, along the outside of the drinking tube 302 through the spout 404, and past the bottle lid 402. This may reduce the build-up of vacuum pressure that may accrue as liquid 410 is drawn through the drinking tube 302.

Figure 5:
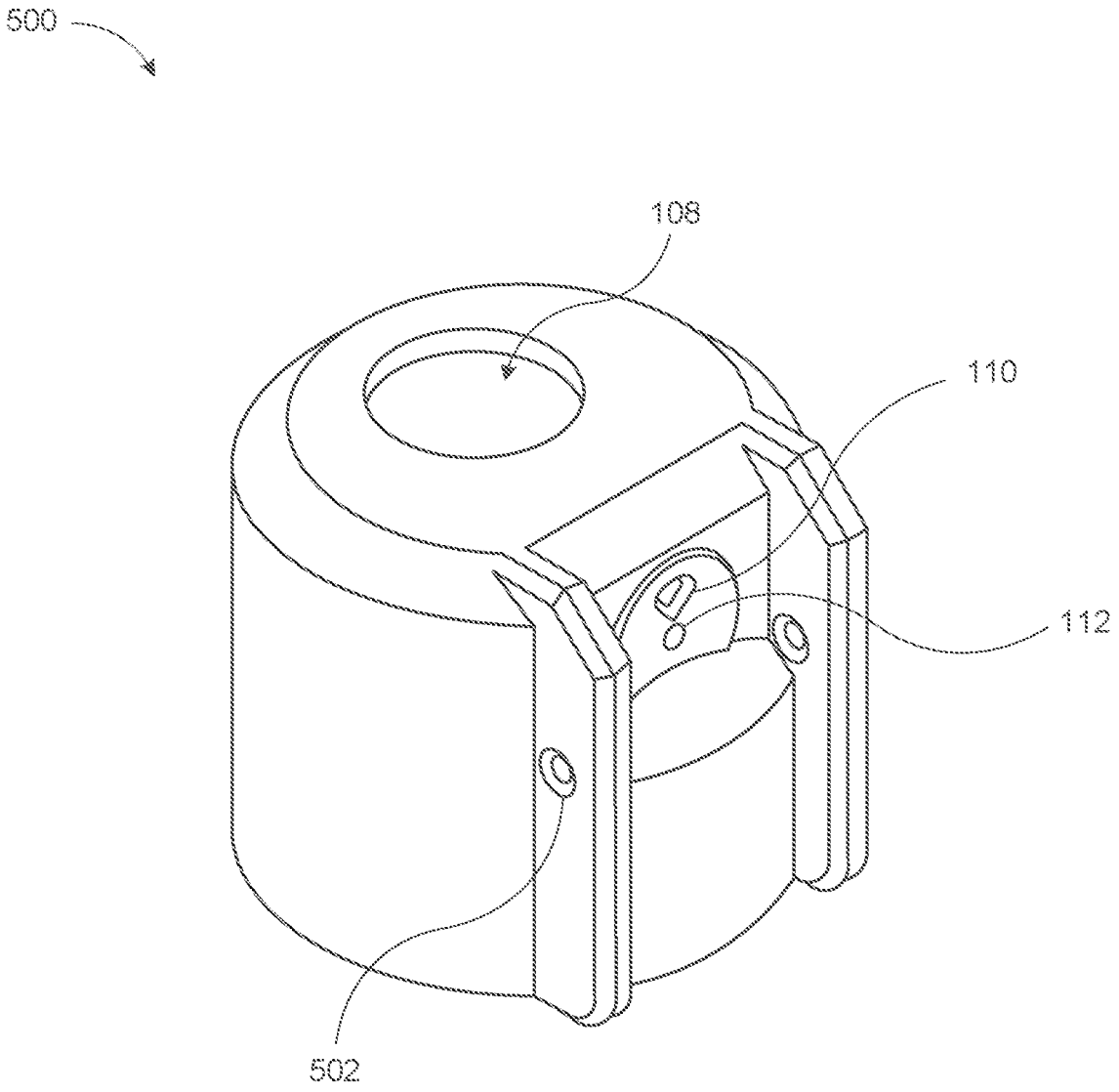
FIG. 5 illustrates a perspective view of a female bottle adapter, according to an embodiment.

FIG. 5 illustrates a perspective view of a female bottle adapter 500, according to an embodiment. Embodiments may allow for coupling to a male connection.

Some embodiments of the bottle adapter 100 may include a female bottle adapter 500 configured to couple to bottles having a male connection. For example, the female bottle adapter 500 may be configured to couple to a Smartwater™ bottle by Glacéau™/Coca-Cola™. The female bottle adapter 500 may include the aperture 108 as described above, a vent orifice 110 disposed on a side of the female bottle adapter 500, and a valve mount 112 to facilitate use of the valve seal 204 also described above. In some embodiments, the female bottle adapter 500 may include one or more mounting locations 502 to facilitate attachment of a lanyard, pack tie, strap, or the like to secure or improve a portability of a bottle via the female bottle adapter 500.

Figure 6:
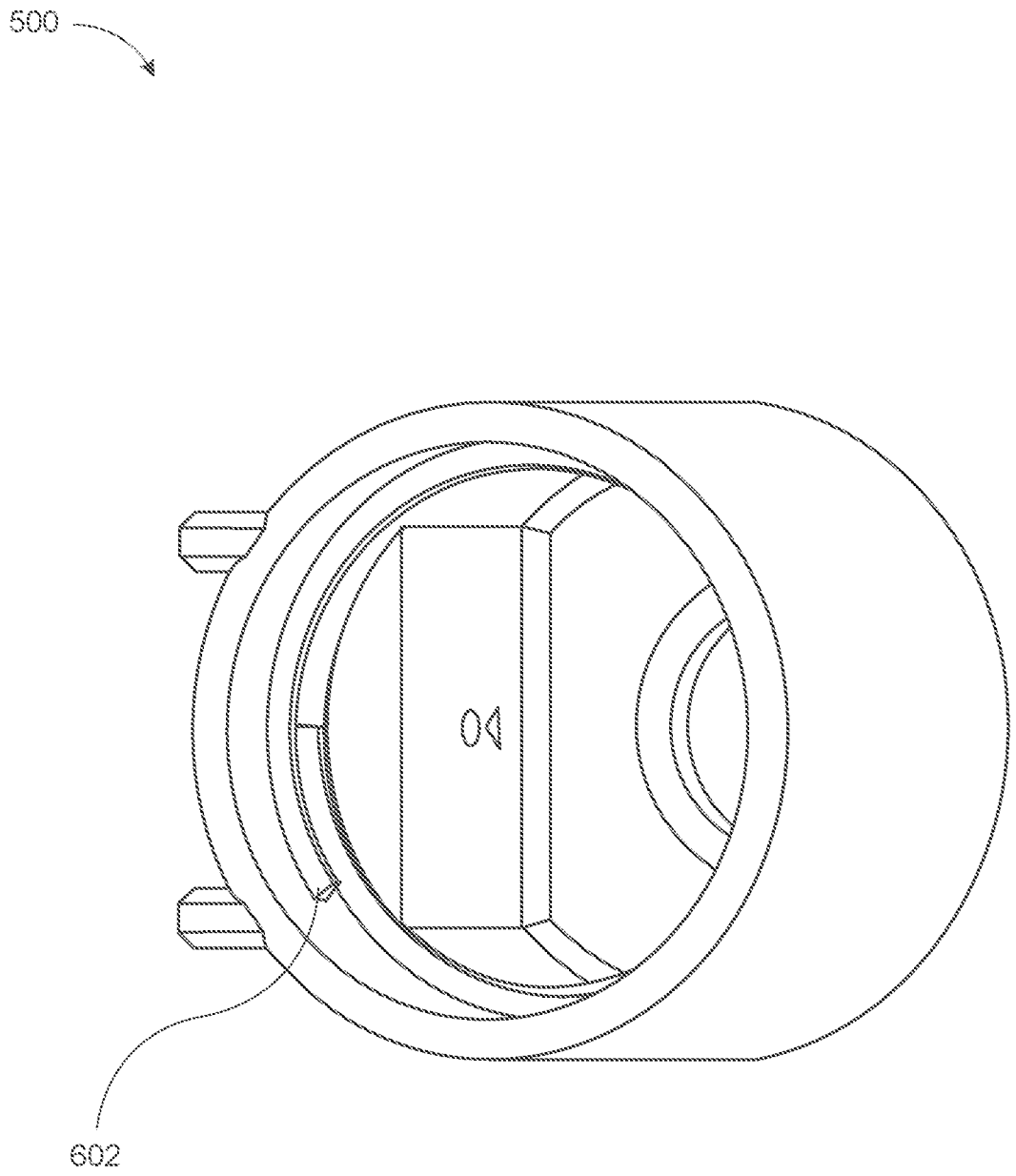
FIG. 6 illustrates a bottom view of the female bottle adapter of FIG. 5, according to an embodiment.

FIG. 6 illustrates a bottom view of the female bottle adapter 500 of FIG. 5, according to an embodiment. Embodiments allow for attachment of a drinking tube to a traditional water bottle.

In some embodiments, the female bottle adapter 500 includes a female thread interface 602 sized and/or shaped to fit a thread pattern of a water bottle. In this manner, a water bottle may be used in conjunction with a drinking tube by replacing the water bottle cap with the female bottle adapter 500. A drinking tube 302 may be inserted into the water bottle via the female bottle adapter 500 to form a leak resistant coupling and allow a user to drink from the water bottle without having to hold the water bottle to their mouth.

Figure 7:
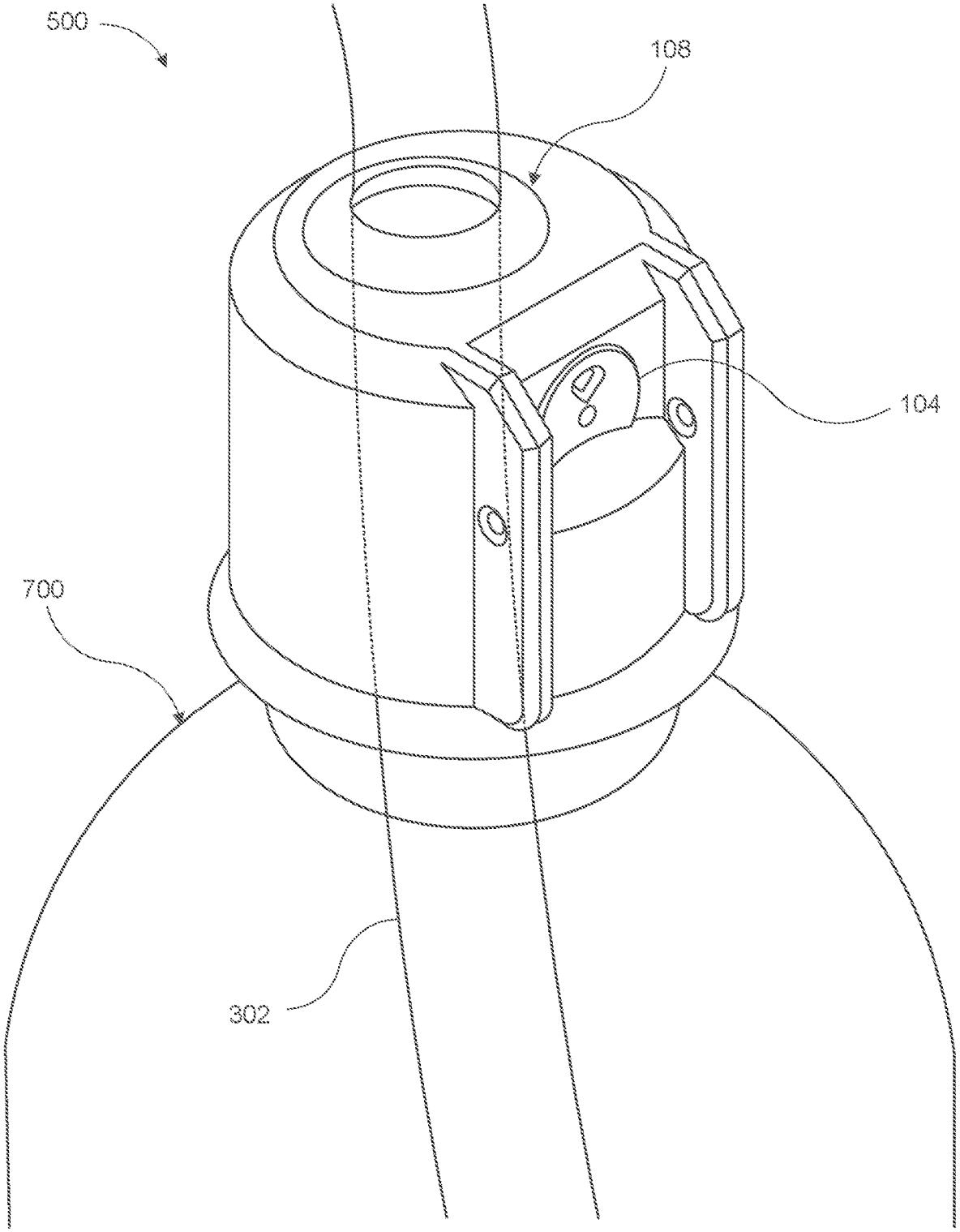
FIG. 7 illustrates a perspective view of the female bottle adapter of FIG. 5 on a bottle, according to an embodiment.

FIG. 7 illustrates a perspective view of the female bottle adapter of FIG. 5 on a bottle, according to an embodiment. Embodiments allow for use of a traditional water bottle in a hands-free manner.

In some embodiments, the female bottle adapter 500 may be coupled to a bottle 700 to position the drinking tube 302 within the bottle 700. The female bottle adapter 500 may be secured to the bottle 700 by threading the female bottle adapter 500 directly onto the bottle 700. In some embodiments, the female bottle adapter 500 may align the aperture 108 with the bottle 700 to allow the drinking tube 302 to pass into the bottle 700 without kinking or obstructing the drinking tube 302. The female bottle adapter 500 may allow air to enter the bottle 700 via the vent structure 104 to reduce vacuum drawn on the bottle 700 during drinking. The vent structure 104 may also reduce passage of fluid from within the bottle 700 through the female bottle adapter 500.

Figure 8:
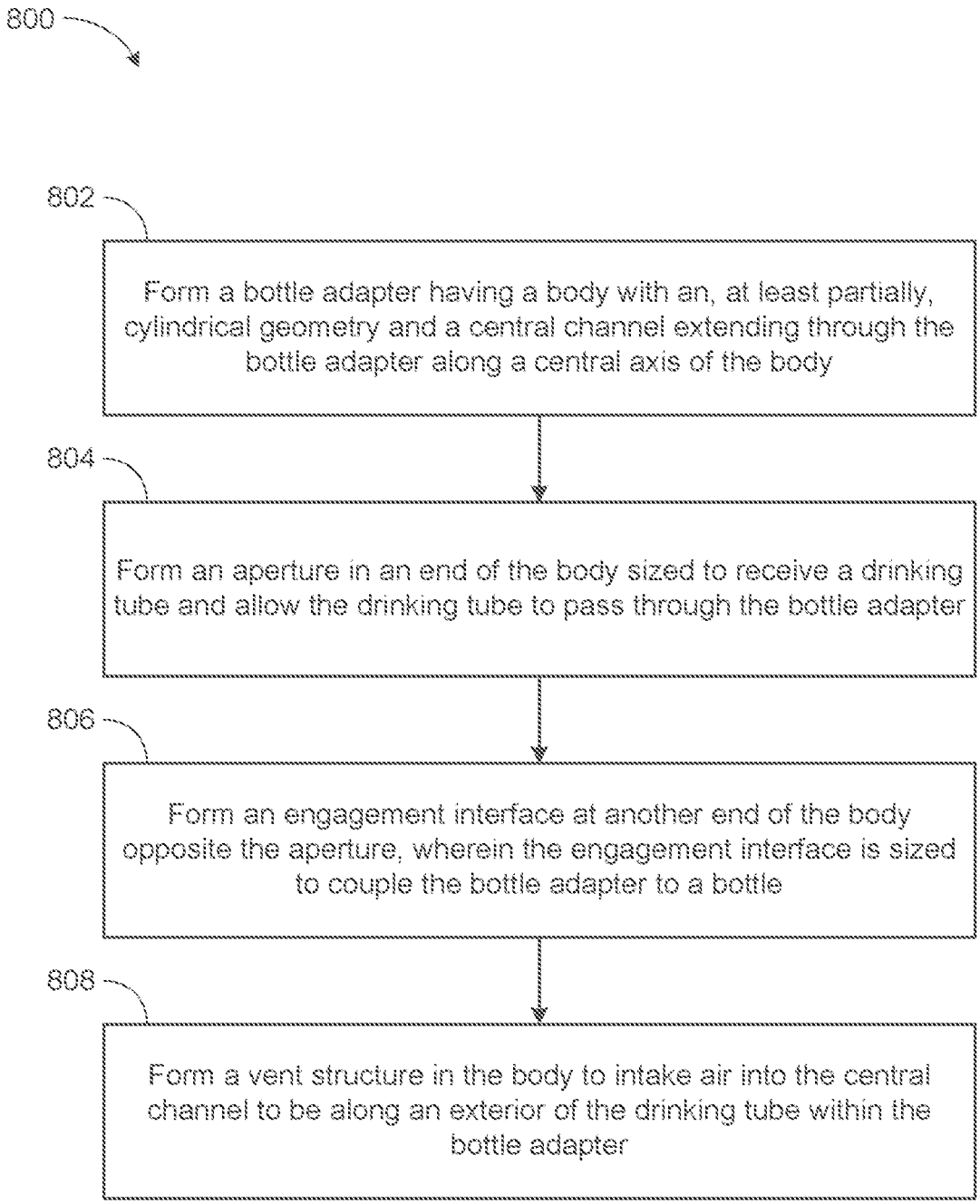
FIG. 8 illustrates a method, according to an embodiment.

FIG. 8 illustrates a method 800, according to an embodiment. Embodiments allow for forming a bottle adapter for attachment to a traditional water bottle.

In some embodiments, the method 800 includes forming a bottle adapter having a body with an, at least partially, cylindrical geometry and a central channel extending through the bottle adapter along a central axis of the body (Block 802). The channel may also be cylindrical in geometry. In some embodiments, the channel is larger in diameter than an outer diameter of the drinking tube.

The method 800 may include forming an aperture in an end of the body sized to receive a drinking tube and allow the drinking tube to pass through the bottle adapter (Block 804). The aperture may have a similar geometry to an outer geometry of a drinking tube.

The method 800 may include forming an engagement interface at another end of the body opposite the aperture. The engagement interface may be sized to couple the bottle adapter to a bottle (Block 806). In some embodiments, the engagement interface may be a threaded interface, a friction fit interface, a gasket interface, or so forth.

The method 800 may include forming a vent structure in the body to intake air into the central channel to be along an exterior of the drinking tube within the bottle adapter (Block 808). In some embodiments, the vent structure includes a vent seal to form a one-way valve arranged to allow air into the bottle adapter through the vent structure and reduce water or other fluid passage back out of the bottle adapter via the vent structure.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (e.g., methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively inclusive elements does not preclude other examples that include various combinations of some or all of the alternatively inclusive elements. An example described using a list of alternatively inclusive elements includes at least one element of the listed elements. However, an example described using a list of alternatively inclusive elements does not preclude another example that includes all of the listed elements. And an example described using a list of alternatively inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower, or equal in scope to the original claims, are to be considered within the subject matter of the examples described herein.

The invention claimed is:

1. A system comprising:

a bottle to contain a liquid;

a drinking tube; and a bottle adapter to couple to the bottle to position the drinking tube within the bottle, the bottle adapter comprising:

a body having an at least partially cylindrical geometry;

an aperture disposed at an end of the body and sized to receive the drinking tube to allow the drinking tube to pass through the bottle adapter;

an engagement interface disposed at another end of the body opposite the aperture to couple the bottle adapter to the bottle;

a central channel extending through the bottle adapter along a central axis of the body; and a vent structure formed in the body to intake air into the central channel along an exterior of the drinking tube within the bottle adapter.

2. The system of claim 1, further comprising a grommet to position within the aperture to secure the drinking tube in the aperture to adjustably hold the bottle adapter at a location along the drinking tube to adjust a relative length of the drinking tube within the bottle.

3. The system of claim 1, further comprising a bite valve positioned at a first end of the drinking tube to allow a user to draw water into the drinking tube, through the bottle adapter, and through the bite valve to the user.

4. The system of claim 1, wherein the engagement interface comprises at least one male thread at least partially surrounding an exterior of the engagement interface.

5. The system of claim 1, wherein the bottle adapter is a female bottle adapter wherein the engagement interface comprises at least one female thread disposed at least partially within the body of the female bottle adapter.

6. The system of claim 1, further comprising a valve seal positioned proximate the vent structure to provide a one-way valve action at the vent structure to allow air to pass into the bottle adapter and equalize pressure during drinking.

7. The system of claim 6, wherein the valve seal comprises a valve stem to protrude through a valve mount of the vent structure.

8. The system of claim 7, wherein the valve seal further comprises a retention structure having an enlarged diameter relative to the valve stem to retain the valve seal proximate the vent structure.

9. The system of claim 8, wherein the vent structure comprises at least one vent orifice positioned to be covered by the vent seal on an interior of the bottle adapter to facilitate the one-way valve action.

10. The system of claim 1, wherein the drinking tube is a single continuous tube extending unbroken into and through the bottle adapter.

11. An apparatus comprising:

a body comprising an at least partially cylindrical geometry; and a central channel extending along a central axis of the body;

an aperture disposed at an end of the body, wherein the apertures is:

sized to receive a drinking tube; and at least partially aligned with the central channel of the body to allow the drinking tube to pass through the aperture and the central channel;

an engagement interface disposed at another end of the body opposite the aperture, wherein the engagement interface is:

configured to couple the body to a bottle; and aligned with the central channel of the body to allow the drinking tube to pass through the engagement interface; and a vent structure formed in the body to intake air into the central channel along an exterior of the drinking tube within the body.

12. The apparatus of claim 11, wherein the engagement interface is configured to form a leak resistant seal with the bottle.

13. The apparatus of claim 11, wherein the engagement interface is a thread interface configured to engage with a complimentary thread interface of the bottle.

14. The apparatus of claim 13, wherein the thread interface is a male thread interface formed on an exterior of the body to be inserted into the complimentary thread interface of the bottle.

15. The apparatus of claim 13, wherein the thread interface is a female thread interface formed on an interior of the body to receive the complimentary thread interface of the bottle within the body.

16. The apparatus of claim 11, further comprising a grommet configured to engage the aperture of the body to apply a friction fit to the drinking tube to secure the drinking tube relative to the body and facilitate adjustment of a length of the drinking tube within the bottle.

17. The apparatus of claim 11, wherein the vent structure is formed on a side of the body to allow air to pass into the body in a direction perpendicular to the central axis of the body.

18. The apparatus of claim 11, further comprising a vent seal disposed at the vent structure to be at least partially within the central channel and configured to restrict fluid flow at the vent structure in response to pressure within the body at the vent structure being higher than pressure outside the body at the vent structure.

19. The apparatus of claim 11, wherein the engagement interface is configured to engage the bottle indirectly through engaging with a lid of the bottle.

20. A method comprising:

forming a bottle adapter having a body with an at least partially cylindrical geometry and a central channel extending through the bottle adapter along a central axis of the body;

forming an aperture in an end of the body sized to receive a drinking tube and allow the drinking tube to pass through the bottle adapter;

forming an engagement interface at another end of the body opposite the aperture, wherein the engagement interface is sized to couple the bottle adapter to a bottle; and forming a vent structure in the body to intake air into the central channel to be along an exterior of the drinking tube within the bottle adapter.

* * * * *